United States Patent [19]

Chezem

[11] Patent Number: 4,673,203

[45] Date of Patent: Jun. 16, 1987

[54] SPRING BIASED DOOR STOP HAVING A VERTICALLY MOVABLE TENSION MEMBER

[75] Inventor: Jimmie A. Chezem, Sparta, Tenn.

[73] Assignee: Plateau Products Corp., Sparta, Tenn.

[21] Appl. No.: 787,627

[22] Filed: Oct. 15, 1985

[51] Int. Cl.[4] ..... E05C 17/54

[52] U.S. Cl. ..... 292/339; 292/338; 292/DIG. 15

[58] Field of Search ..... 292/338, 339, 341.17, 292/341.18, 341.19, 342, 343, 348, 355, DIG. 15

[56] References Cited

U.S. PATENT DOCUMENTS

| | | | |
|---|---|---|---|
| 1,915,795 | 6/1933 | MacMillan | 292/338 |
| 1,921,568 | 8/1933 | Hasselberger | 292/338 |
| 3,737,186 | 6/1973 | Chezem | 292/338 |
| 3,809,419 | 5/1974 | Chezem | 292/338 |
| 4,163,574 | 8/1979 | Chezem | 292/338 |
| 4,514,000 | 4/1985 | Chezem | 292/338 |

*Primary Examiner*—Henry E. Raduazo
*Attorney, Agent, or Firm*—Donald A. Kettlestrings

[57] ABSTRACT

A non-key operated lock for the door of an occupied room comprising a vertically elongated prop member pivotally mounted to a guide member at its upper end for oscillation about a horizontal axis for movement between a first inoperative downwardly and outwardly inclined position with the lower end of the prop member spaced above the lower marginal edge of the door and a second operative position with the lower end of the prop member swung toward the door and projecting at least slightly below the door lower marginal edge for engagement with a horizontal surface, such as a floor, over which the lower marginal edge moves when the door is moved toward the open position thereof. The prop member is yieldingly biased toward the inoperative position and an elongated tension member extends between the guide and prop member and includes opposite end portions slidably anchored to the guide and prop member for guided gravity biased movement downwardly therealong and a counter balance weight for assisting in the gravity biased movement. A first form of the invention is permanently mounted on the associated door and a second form of the invention is portable and may be quickly removably mounted on an associated door.

18 Claims, 11 Drawing Figures

Fig. 1.
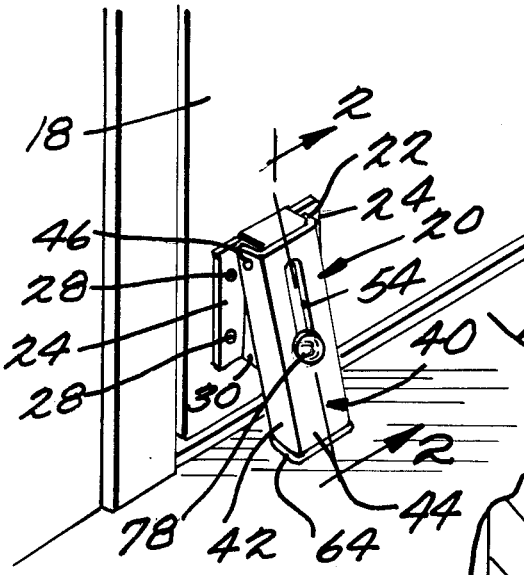
Fig. 2.
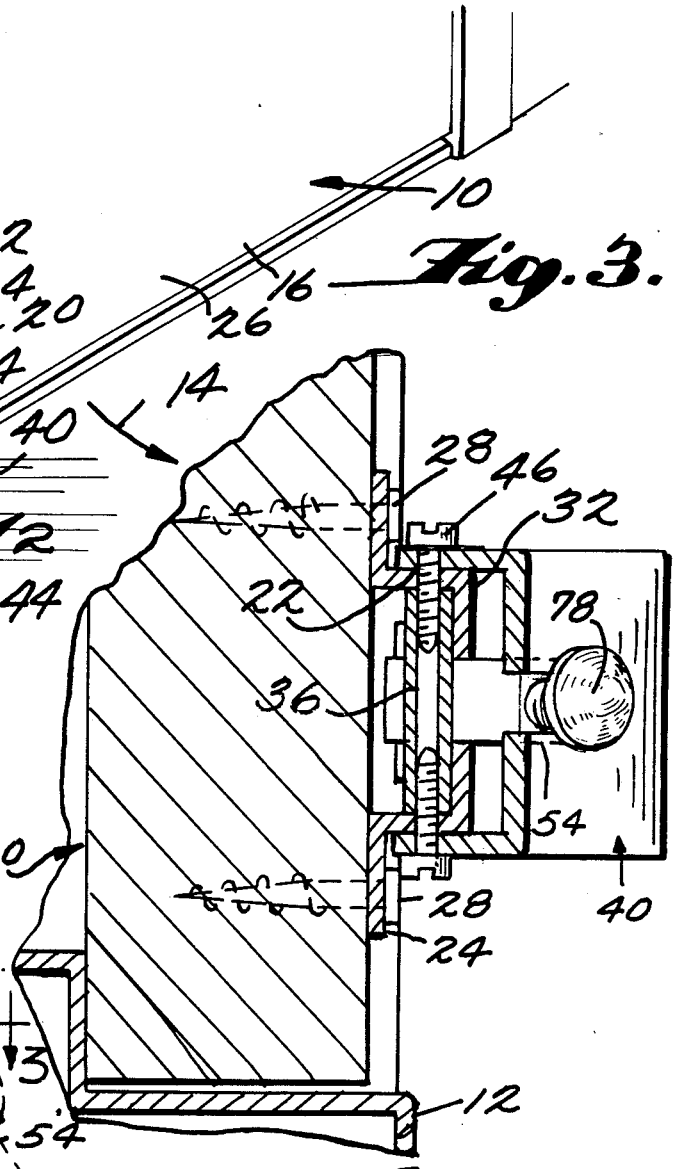
Fig. 3.
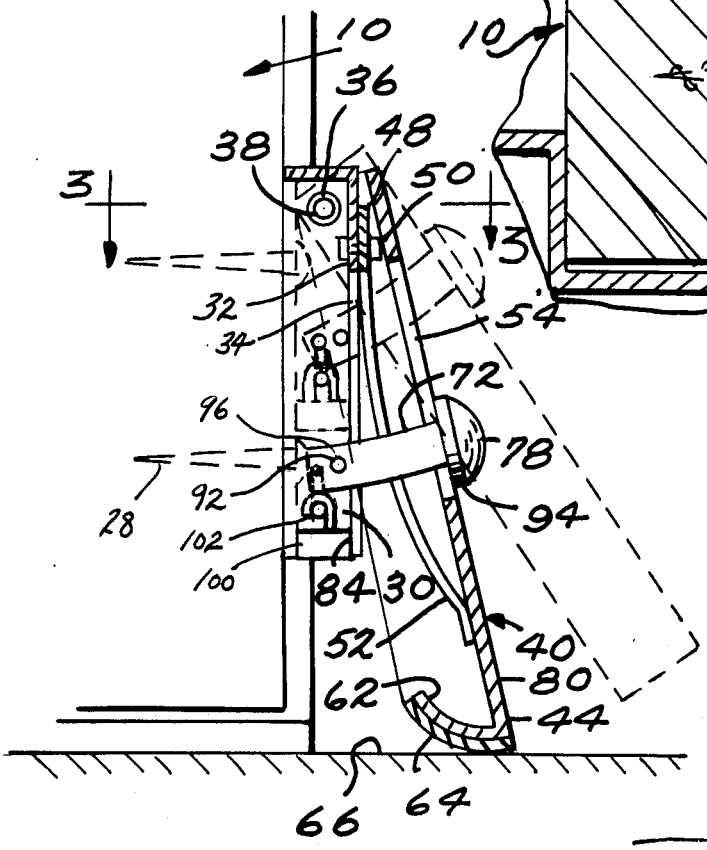
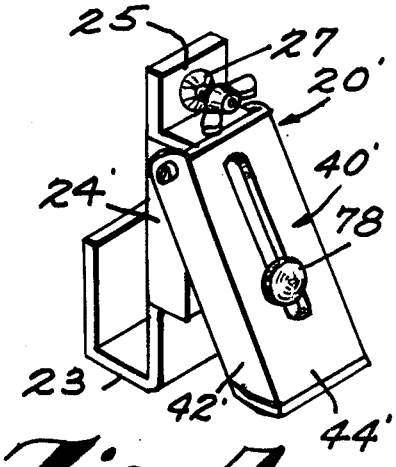
Fig. 4.

SPRING BIASED DOOR STOP HAVING A VERTICALLY MOVABLE TENSION MEMBER

BACKGROUND OF THE INVENTION

Various different forms of locks are known whereby doors may be locked in closed positions. However, recent increases in breaking and entering and other forms of crime wherein perpetrators of crime gain entrance into a locked door secured area while persons are in those areas have created near panic situations in some areas of high crime frequency with the result that many persons are utilizing double and even triple locks on doors. However, the utilization of double and triple key operated locks on doors requires the use of additional keys and unnecessarily increases the number of door locking keys which must be carried and replaced, if lost. Furthermore, it is reasonably well established that most homes can be broken into when the homes are unoccupied through forced entries other than by forcing a locked door. Accordingly, the main interest in providing a more secure door lock is to prevent entry through the door while the home is occupied.

It is therefore apparent that a non-key operated lock needs to be provided as a door locking device which may be actuated by a person within a home or the like without the use of a key and with little expense.

BRIEF DESCRIPTION OF THE INVENTION

The door stop or lock of the instant invention, in a first form thereof, is constructed in a manner whereby it may be readily attached to the inner surface of a door and utilized either independent of or in conjunction with a conventional key operated door lock in order to increase the locked security of a door by a person disposed within the area secured by the locked door.

The door stop or lock is constructed in a manner such that it also may be used as a replacement for a "night chain" type of lock wherein an associated door may be partially opened and prevented from being further opened, if desired.

A second form of the door lock is constructed in a manner whereby it may be readily temporarily mounted upon an associated door of a hotel or motel room and the like and thus carried by a traveler in order that he or she may rest assured that entry into his or her motel or hotel room will be prevented while the room is occupied.

The main object of this invention is to provide a supplemental door lock which may be used to securely lock a door from the inside and which does not require the use of a key.

Another object of this invention is to provide a door lock which may also function as a "night chain".

Still another important object of this invention is to provide a door lock which may be readily mounted upon an associated door through the utilization of simple tools.

A further object of this invention is to provide a door lock in accordance with the preceding objects and of the portable type whereby the door lock may be carried by a traveler and quickly operatively associated with a motel or hotel room door, if desired.

A final object of this invention to be specifically enumerated herein is to provide a door lock in accordance with the preceding objects and which will conform to conventional forms of manufacture, be of simple construction and easy to use so as to provide a device that will be economically feasible, long lasting and relatively trouble free in operation.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

BRIEF DESCRIPTION OF THE DRAWINGS

FIG. 1 is a fragmentary perspective view illustrating the manner in which a first form of door lock constructed in accordance with the present invention may be operatively semi-permanently mounted on the interior of a door;

FIG. 2 is an enlarged fragmentary vertical sectional view taken substantially upon the plane indicated by the section line 2—2 of FIG. 1 and illustrating an inoperative position of the door locking portion of the invention in phantom lines;

FIG. 3 is a horizontal sectional view taken substantially upon the plane indicated by the section line 3—3 of FIG. 2;

FIG. 4 is a perspective view of a modified form of door lock adapted for ready removable support from a hotel or motel room door;

FIG. 6 is a fragmentary perspective view similar to FIG. 1, but illustrating a third form of door lock to be removably supported from a hotel or motel room door and including structure whereby variations in the height of the lower edge of the door above the floor surface on the inside of the door may be compensated for;

DETAILED DESCRIPTION OF THE INVENTION

Figure 10:
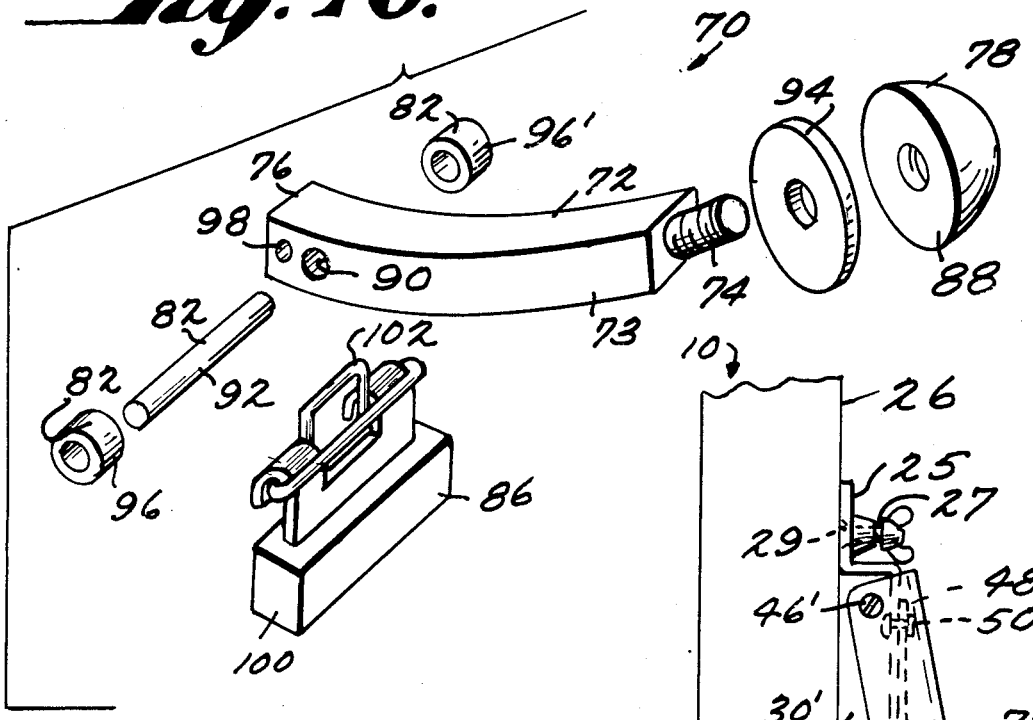
FIG. 10 is an exploded perspective view of the tension member means.

Referring now more specifically to the drawings the numeral 10 generally designates a horizontally swingable door mounted in a door frame or jamb 12. The door 10 is swingable in the direction of arrow 14 toward an open position. Door 10 includes a lower marginal edge portion 16 and a free swinging edge portion 18.

The door stop or lock of the instant invention is referred to in general by the reference numeral 20 and includes a vertically disposed generally U-shaped base 22 including oppositely positioned and laterally outwardly directed and apertured mounting flanges 24 by which base 22 is secured to inner surface 26 of the door 10 by suitable threaded fasteners 28. Base 22 includes parallel legs 30 between which a bight portion 32 extends, and bight portion 32 includes a first centrally positioned longitudinally extending and vertically disposed slot 34 formed therethrough for a purpose to be more fully set forth.

A split rolled pin 36 has its opposite ends rotatably received within aligned apertures 38 provided therefor in the upper ends of legs 30, and door stop 20 further includes a vertically elongated prop member referred to in general by the reference numeral 40 which is also U-shaped in configuration and includes a pair of parallel opposite side legs 42 and a connecting bight portion 44. Prop member 40 is of slightly greater width than base 22, and the upper end of prop member 40 loosely receives the upper end of base 22 therein with threaded pivot fasteners 46 being secured through suitable apertures provided therefor in legs 42 and threadedly engaged in the adjacent ends of rolled pin 36. In this manner, prop member 40 is pivotally supported from base 22.

A slotted leaf spring 48 is provided and is secured by rivets 50 to the upper end portion of bight portion 32 and includes arcuate spring fingers 52 which engage and yieldingly outwardly bias the lower end of bight portion 44 of prop member 40. Bight portion 44 is provided with a second longitudinal slot 54 aligned with slot 34, and tension member means 70 are in operative relationship with base 22 and with prop member 40 for controlling movement of prop member 40 with respect to base 22. Tension member means 70 include a curved, rigid member 72 which is slidably received in slots 34 and 54. Curved member 72 has a concave side 73 which is oriented toward pin 36, and member 72 defines a first threaded end 74 and a second end 76. Member 72 extends between and through slots 34 and 54, and a first head member 78 is removably attached to first end 74.

Means 82 are provided in operative relationship with second end 76 and with base 22 for contacting an inner surface 84 of bight portion 32 adjacent to slot 34. Means 86 are also provided in operative relationship with second end 76 of curved member 72 for counterbalancing the weight of head member 78 and for maintaining friction pad 94 in flush contact with outer surface 80.

In accordance with this invention, curved, rigid member 72 defines a first opening 90 substantially perpendicular to an imaginary curved longitudinal axis (not shown) of curved member 72 and substantially parallel to inner surface 84 of bight portion 32. Contacting means 82 include a pin 92 positioned within first opening 90 and projecting beyond the margins of curved member 72 for contacting inner surface 84.

Friction pad 94 is preferably positioned between head member surface 88 and curved member 72 for engaging outer surface 80 of prop member 40, and friction members 96, 96' are positioned over the ends of pin 92 for engaging inner surface 84 of base 22.

Counterbalancing means 86 include a weight 100 suspended from second end 76 of curved member 72. More specifically, curved member 72 defines a second opening 98 substantially parallel to first opening 90 and located between first opening 90 and second end 76. Counterbalancing means 86 include a fastener member 102 positioned within second opening 98 and projecting beneath and to both sides of rigid member 72, and weight 100 is rotatably suspended from fastener member 102.

In operation, when prop member 40 is deflected slightly inwardly toward lower marginal edge portion 16 of door 10, head member 78 and the attached curved rigid member 72 may be displaced upwardly toward the upper ends of slots 34 and 54 whereby inward pressure on the lower end of prop member 44 may be released and spring fingers 52 will yieldingly bias the lower end portion of prop member 40 upwardly and outwardly toward the phantom line position illustrated in FIG. 2 of the drawings with the lower end of prop member 40 spaced appreciably above floor 66. When prop member 40 is swung to the inoperative position, illustrated in phantom lines in FIG. 2, door 10 may be swung inwardly along path 14 toward the open position thereof.

If it is desired to lock door 10 in the closed position illustrated in FIG. 1, the door is closed and inward foot pressure may then be applied to the lower end of prop member 40 to swing the prop member inwardly from the phantom line position thereof illustrated in FIG. 2 to the solid line position of FIG. 2 with the lower end of prop member 40 engaged with floor 66. The length of prop member 40 is slightly greater than the vertical distance between floor 66 and pin 36. As prop member 40 is swung inwardly toward the solid line position of FIG. 2, rigid member 72 falls, by gravity, to the solid line position thereof illustrated in FIG. 2, and movement of prop member 40 back to the inoperative position is prevented. Any attempt to open door 10 is prevented by by prop member 40.

The improved structure of tension member means 70 maintains rigid member 72 in a constantly balanced position so that friction pad 94 is always maintained in flush contact with outer surface 80 of prop member 40 regardless of the position of rigid member 72 as it slides along the lengths of slots 34 and 54. The curved configuration of rigid member 72 combined with the counterbalancing action of weight 100 insures flush contact of pad 94 with outer surface 80 so that forces exerted on pad 94 are evenly distributed thereover.

Similarly, friction members 96, 96' receive and efficiently distribute forces applied to the friction members by inner surface 84 of base 22.

If door 10 is to be opened only slightly from the closed position thereof illustrated in FIG, 1, prop member 40 may be initially released for swinging toward the phantom line position illustrated in FIG. 2, and as door 10 is opened slightly foot pressure may be applied to the lower end of prop member 40 to engage floor 66 therewith. Any attempt to further open the door will be resisted by prop member 40, and any subsequent slight movements of the lower marginal edge portion 16 of door 10 toward the closed position, which may be effected by a person disposed on the inside of door 10, will result in the lower end of prop member 40 gaining further engagement with floor 66 at points spaced closer to jamb or frame 12.

Figure 5:
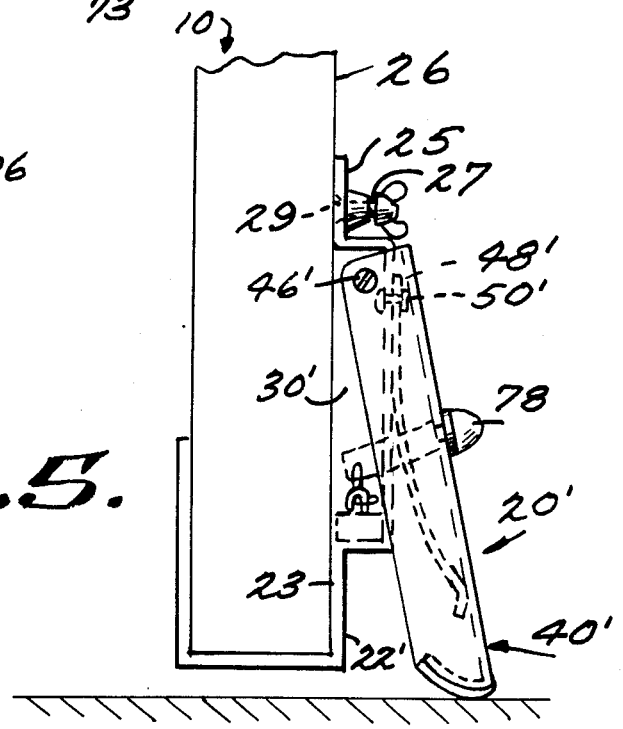
FIG. 5 is an enlarged edge elevational view of the modified form of door lock illustrated in FIG. 4 as mounted on a door.
Figure 11:
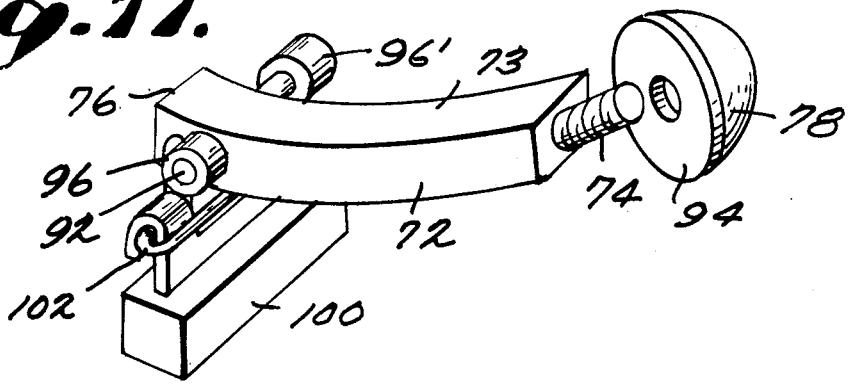
FIG. 11 is a perspective view of the tension member means in partially assembled form.
Figure 6:
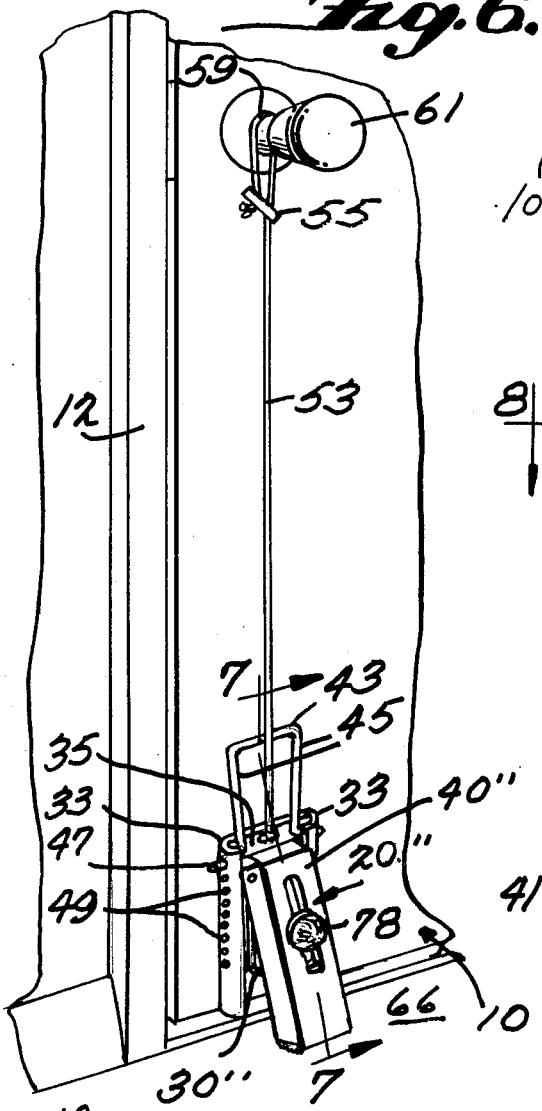

With attention invited now to FIGS. 4 and 5 of the drawings, there may be seen a modified form of door stop referred to in general by the reference numeral 20'. The various components of door stop 20' which correspond to similar components of door stop 20 are designated by prime reference numerals given the corresponding components of door stop 20. Door stop 20' differs from door stop 20 in that the lower end of base 22 includes a U-shaped portion 23 which removably embracingly engages the lower marginal edge portion of door 16. Portion 23 may be engaged with the lower marginal edge portion of door 16 when prop member 40' is in the raised inoperative position and the free swinging edge of door 18 has been swung away from jamb or frame 12. In addition, the upper portion of base 22 includes an apertured flange portion 25 through which a thumb head equipped screw shaft 27 is threaded, and the inner end of screw shaft 27 includes an enlarged abutment head 29 which is engageable with inner surface 26 of door 10. In this manner, the modified form of door stop 20′ may be removably clamped to door 10. Otherwise, the structure and operation of door stop 20′ is identical to the structure and operation of door stop 20.

It is to be noted that spring means other than leaf spring 48 may be used to yieldingly bias prop member 40 to the raised inoperative position. Further, the non-slip panel or coating 64 may be replaced by a resilient block, if desired. Also, the outer edge of the lower end of prop member 40 may be provided with a resilient abutment block in order that door stop 20 may also function as a cushioning member to cushion full opening movement of door 10 back against the wall from which door 10 is pivoted.

Figure 7:
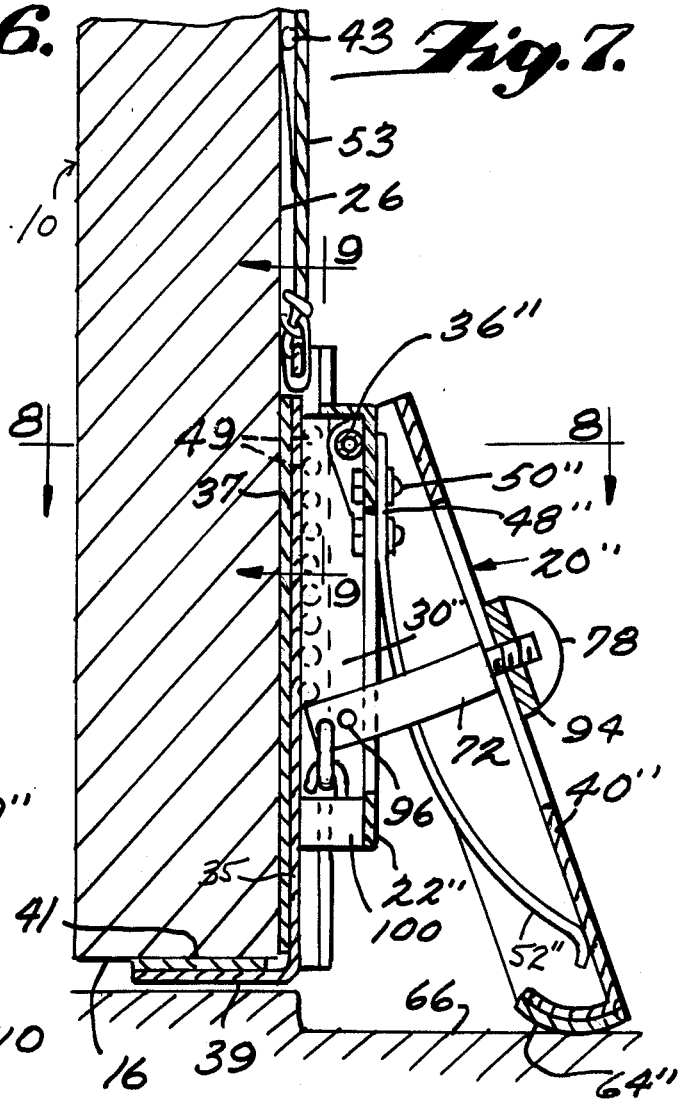
FIG. 7 is an enlarged vertical sectional view taken substantially upon the plane indicated by the section line 7—7 of FIG. 6.
Figure 8:
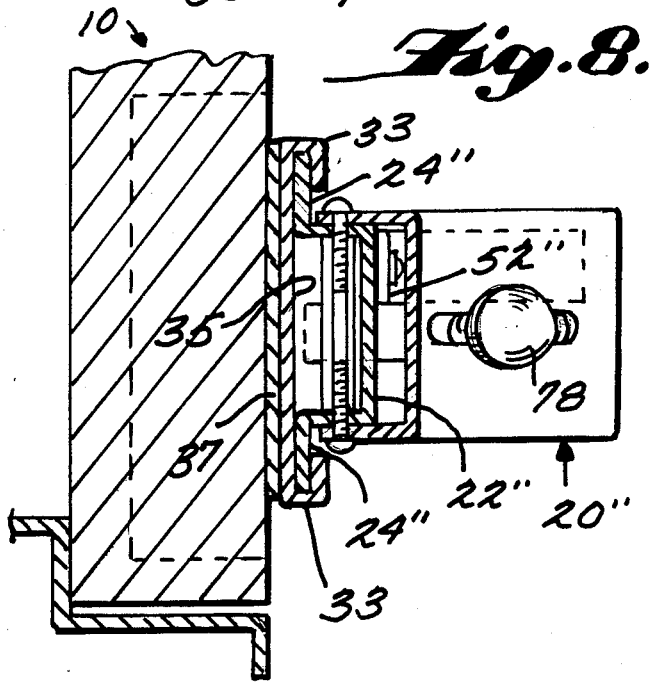
FIG. 8 is is a horizontal sectional view taken substantially upon the plane indicated by the section line 8—8 of FIG. 7.
Figure 9:
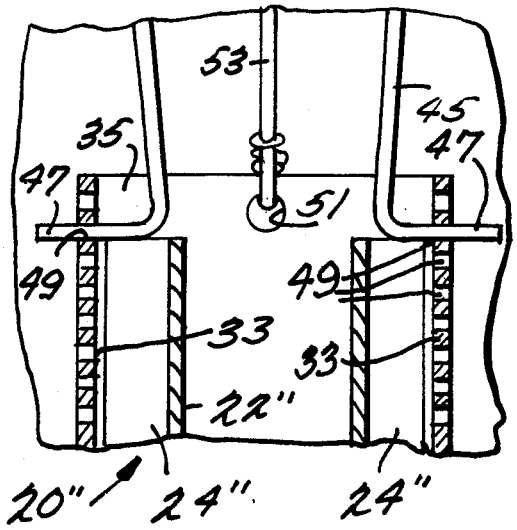
FIG. 9 is a vertical sectional view taken substantially upon the plane indicated by the section line 9—9 of FIG. 7.

With attention now invited to FIGS. 6, 7, 8 and 9 of the drawings, there may be seen a second modified form of door stop referred to in general by the reference numeral 22″ and which is substantially identical to door stop 20, except that U-shaped base 22″ corresponding to base 22, may or may not be provided with openings for receiving fasteners such as fasteners 28 through flanges 24″ of U-shaped base 22″. Rather, instead of utilizing fasteners such as fasteners 28 to secure U-shaped base 22 to the inner face of door 10, flanges 24″ are slidably received in opposing side channel portions 33 of a mounting plate 35 backed by a resilient pad 37. In addition, door lock 20″ includes only a single arcuate spring finger 52″ corresponding to spring fingers 52. The elements denoted by numerals 36″, 48″, 50″, 52″ and 64″ in FIGS. 7 and 8 are the same as those disclosed in the previous Figures except for the ″ which denotes the FIGS. 6–9 embodiment.

The lower end of mounting plate 35 includes a right angle flange portion 39 equipped with a resilient pad 41 and flange 39 is received beneath the lower marginal edge portion 16 of door 10 in the manner illustrated in FIG. 7 of the drawings with resilient pad 37 abutting against inner surface 26 of door 10. In addition, a U-shaped bail 43 is provided and constructed of spring-type rod material. The free ends of legs 45 of bail 43 include outturned terminal ends 47 which are removably received through corresponding longitudinally spaced bores 49 formed in channel portions 33. The terminal ends 47 limit upwardly sliding movement of flanges 24″ in channel portions 33, and the upper marginal edge of mounting plate 35 is provided with an aperture 51 through which one end of an elastic (nylon) tension member 53 is secured. The other end of tension member 53 is equipped with a loop-forming strip 55 having one end anchored relative to tension member 53 and slidably receiving an intermediate length portion of the tension member 53 through the other end. Accordingly, strip 55 forms a loop 59 in the end of tension member 53 remote from mounting plate 35, and loop 59 may be passed over door knob 61 supported from door 10. Thereafter, strip 55 may be pulled downwardly along that portion of tension member 53 extending between knob 51 and mounting plate 35 in order to tightly tension that portion of the tension member. In this manner, mounting plate 35 may be securely anchored relative to the inner side and lower marginal edge portion of door 10 independent of door 10 being open. After door lock 20″ has been mounted on door 10, prop member 40″ thereof corresponding to prop 40 may be readily inwardly and downwardly displaced into tight engagement with floor 66 inwardly of door 10.

It will be noted that door lock 20 may be readily converted into a door lock 20″ merely by the addition of mounting plate 35, bail 43 and tension member 53 to the basic structure of door lock 20.

If the lower marginal edge portion 16 of door 10 is appreciably spaced above floor surface 66 inwardly of door 10, terminal ends 47 of bale 43 may be inserted through bores 49 spaced lower along the channel portions 33. Conversely, if the level of floor surface 66 is only slightly below the lower marginal edge of door 10, terminal ends 47 may be inserted through corresponding bores 49 spaced further upward along channel portions 33.

Still further, it is also possible to provide inturned flange 39 with an upwardly directed flange such as the outer flange of U-shaped portion 23, thereby providing a U-shaped portion at the bottom of mounting plate 35. However, in order to install a door stop or lock 20″ equipped in this manner, it would be necessary to open the door in order that the U-shaped portion could be slid into engagement with the lower marginal edge of the door from the free swinging edge thereof. Accordingly, and particularly inasmuch as tension member 53 provides ample mounting of mounting plate 35 on door 10, in many instances it will be desirable to provide a portable door lock or stop which is constructed in the manner of door lock 20″ as opposed to door lock 20′.

The invention in its broader aspects is not limited to the specific details shown and described, and departures may be made from such details without departing from the principles of the invention and without sacraficing its chief advantages.

What is claimed is:

1. A door stop, comprising:

a base for mounting upon a door adjacent to a lower marginal edge portion of an internal surface of said door, said base including a bight portion and a first vertically disposed slot defined within and through said bight portion;

an elongated prop member defining an outer surface and further defining a second longitudinal slot within and through said outer surface;

pin means in operative relationship with said base and said prop member for pivotally mounting an upper portion of said prop member to an upper portion of said base and for enabling movement of said prop member about a substantially horizontal axis between a first inoperative position with a lower end of said prop member located above the floor and a second operative position with said lower end of said prop member located below said lower marginal edge portion and in engagement with said floor;

means in operative relationship with said base and said prop member for yieldingly biasing said prop member toward said inoperative position; and tension member means in operative relationship with said base and with said prop member for controlling movement of said prop member with respect to said base, said tension member means including an elongated curved rigid member having a concave portion thereof oriented toward said pin means, said rigid member defining first and second ends and extending between and through said first and said second slots in slidable relationship with said slots, a first head member removably attached to said first end and engaging said outer surface of said prop member, means in operative relationship with said second end and with said base for contacting an inner surface of said bight portion adjacent to said first slot, and means in operative relationship with said second end for counterbalancing the weight of said first head member and for maintaining a predetermined portion of said first head member in flush contact with said outer surface.

2. A door stop as in claim 1 wherein said curved, rigid member defines a first opening substantially perpendicular to the curved longitudinal axis of said curved member and substantially parallel to said inner surface of said bight portion, and wherein said contacting means include a pin positioned within said first opening and projecting beyond the margins of said curved member for contacting said inner surface.

3. A door stop as in claim 2 wherein said head member defines a surface and further including a friction pad positioned between said head member surface and said curved member for engaging said outer surface, and friction members positioned over the ends of said pin for engaging said inner surface.

4. A door stop as in claim 1 wherein said counterbalancing-means include a weight suspended from said second end.

5. A door stop as in claim 4 wherein said curved, rigid member further defines a second opening substantially parallel to said first opening and located between said first opening and said second end, and wherein said counterbalancing means include a fastener member positioned within said second opening and projecting beneath and to both sides of said rigid member, and said weight rotatably suspended from said fastener member.

6. A door stop as in claim 1 wherein said biasing means comprise a leaf spring having longitudinally spaced portions thereof engaged with said prop member and said base.

7. A door stop as in claim 1 wherein the lower end of said prop member includes a non-slip portion.

8. A door stop as in claim 1 wherein said base includes a pair of coplanar apertured mounting flanges through which fasteners may be secured for mounting said base on a door with said mounting flanges abutting the inner surface of said door.

9. A door stop as in claim 1 wherein said base includes an upwardly opening generally channel shaped lower portion for embracingly engaging the lower marginal portion of a door and wherein an upper portion of said base includes a threaded abutment screw supported therefrom for abuttingly engaging the inner surface of a door.

10. A door stop as in claim 1 wherein said base and prop members include nested and relatively pivotable channel members of generally U-shaped cross section with the axis of relative oscillation thereof extending transversely of said channel members, the bight portions of said channel members being provided with registered longitudinal slots.

11. A door stop as in claim 10 wherein said means operatively connected between said base and said prop member yieldingly biasing the prop member toward said inoperative position comprises a leaf spring having longitudinally spaced portions thereof engaged with said prop member and said base.

12. A door stop as in claim 11 wherein the lower end of said prop member includes a non-slip portion.

13. A door stop as in claim 12 wherein said base includes a pair of coplanar apertured mounting flanges through which fasteners may be secured for mounting said base on a door with said mounting flanges abutting the inner surface of said door.

14. A door stop as in claim 12 wherein said base includes an upwardly opening generally channel-shaped lower portion for embracingly engaging the lower marginal portion of a door, and wherein an upper portion of said base includes a threaded abutment screw supported therefrom for abuttingly engaging the inner surface of a door.

15. A door stop as in claim 1 wherein said base includes a pair of coplanar mounting flanges, and further including a mounting plate defining opposing side channel portions opening toward each other and in which said mounting flanges are slidingly received, one marginal edge portion of said mounting plate extending transversely of and being disposed adjacent one pair of corresponding ends of said channel portions and said mounting plate further including means engaging the lower marginal edge portion of an associated door, said channel portions being provided with longitudinally spaced pairs of registered bores, abutment pin means receivable through a selected pair of registered bores and engageable by said flanges to limit sliding movement of said base away from said one marginal portion of said mounting plate, said stop further including an elastic tension member, the marginal edge portion of said mounting plate remote from said one marginal edge portion thereof having one end of said elastic tension member anchored relative thereto, the other end of said elastic tension member including means for forming an adjustable size loop for passage over an associated door knob.

16. A door stop as in claim 15 including a generally U-shaped bail defining oppositely laterally outwardly directed legs and wherein said abutment pin means comprise said oppositely laterally outwardly directed terminal ends of said legs.

17. A door stop for selectively preventing swinging movement of a door in one direction comprising a base adapted to be engaged with the face of a door which faces the direction of movement and adjacent the lower edge thereof, a prop member, means pivotally connecting the upper end of the prop member to the base for pivotal movement about a generally horizontal axis, means on the lower end of said prop member for engaging a floor surface when the prop member is in operative position approaching parallelism with the face of the door, the length of the prop member being slightly greater than the vertical distance between the floor and said axis, means in operative relationship with said base and with said prop member for biasing said prop member to an inoperative position with the lower end of said prop member spaced from the floor, and means interconnecting the base and prop member in spaced relation to said pivot axis for limiting movement of said prop member toward said inoperative position, said limiting means including a retainer vertically movable with respect to said prop member and base to enable unrestricted pivotal movement of said prop member toward said operative position, said retainer being gravitationally moved vertically to various positions to prevent movement of said prop member toward said inoperative position after movement of said prop member toward said operative position, wherein said base defines a vertically disposed slot, said prop member defining a longitudinal slot aligned with said slot in said base, said retainer comprising an elongated curved rigid member having a concave portion thereof oriented toward said pivot axis, said rigid member extending through and slidably received in said slots, each end of said rigid member being laterally enlarged to prevent movement through the slots while permitting free sliding movement of said rigid member in relation to said slots, the length of said rigid member is moved upwardly in said slots toward said pivot axis, said rigid member falling by gravity away from said pivot axis as said prop member swings toward said operative position until the lower end of said prop member contacts the floor, said rigid member automatically and positively retaining said prop member in any position to which it is moved when the lower end of said prop member contacts the floor with said prop member in acute angular relation to the face of the door thereby preventing movement of the door in one direction until said rigid member is moved toward said pivot axis.

18. The door stop as defined in claim 17 together with means mounting said base adjustably and removably on a door to enable use of the door stop with doors spaced various distances above a floor and to enable the door stop to be carried to a site of use and easily and quickly installed on a door.

* * * * *